United States Patent [19]

Watanabe

[11] Patent Number: 5,011,447

[45] Date of Patent: Apr. 30, 1991

[54] BALLOON HOLDER

[75] Inventor: Hajime Watanabe, Saitama, Japan

[73] Assignee: Superloon K.K., Tokyo, Japan

[21] Appl. No.: 541,677

[22] Filed: Jun. 21, 1990

[30] Foreign Application Priority Data

Jun. 28, 1989 [JP] Japan ..... 1-76116[U]

[51] Int. Cl.[5] ..... A63H 3/06

[52] U.S. Cl. ..... 446/220; 242/96

[58] Field of Search ..... 446/220, 225, 226, 221, 446/222, 223; 242/96, 84.8

[56] References Cited

U.S. PATENT DOCUMENTS

| | | | |
|---|---|---|---|
| 1,037,465 | 9/1912 | Frissell | 242/96 |
| 2,722,775 | 11/1955 | Rinker | 446/220 |
| 3,310,024 | 3/1967 | McConnell | 446/220 |
| 4,088,276 | 5/1978 | Littleton | 242/96 |
| 4,475,652 | 10/1984 | Heard | 242/96 |
| 4,542,863 | 9/1985 | Larson | 242/96 |

FOREIGN PATENT DOCUMENTS

| | | | |
|---|---|---|---|
| 1346427 | 11/1963 | France | 446/225 |

*Primary Examiner*—Richard J. Johnson

*Attorney, Agent, or Firm*—Browdy and Neimark

[57] ABSTRACT

This invention relates to a balloon holder comprising an external cap having a slit through which a string is pulled out, and an internal cap to be fitted to the external cap. When the holder is fitted to a balloon, the total weight of the holder is greater than buoyancy of the balloon. Accordingly, the balloon does not fly away when one lets the string go. The length of the string can be adjusted or the string can be fixed to prevent string pull-out by rotating the external and internal caps.

4 Claims, 2 Drawing Sheets

FIG.3A
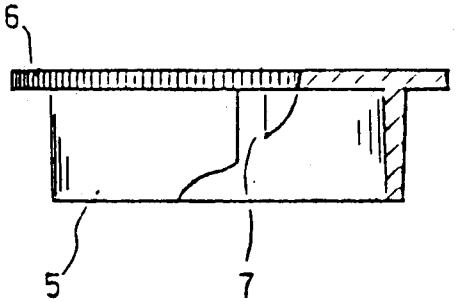
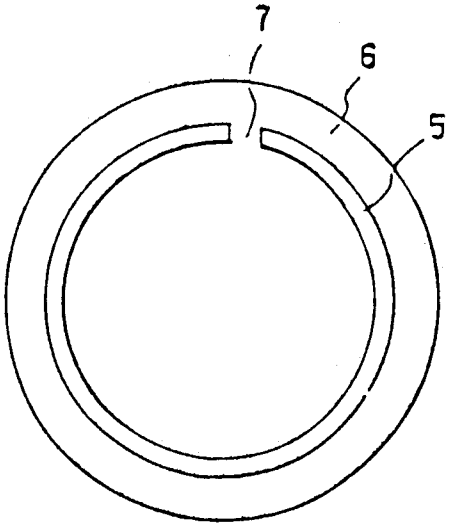
FIG.3B
FIG.2A
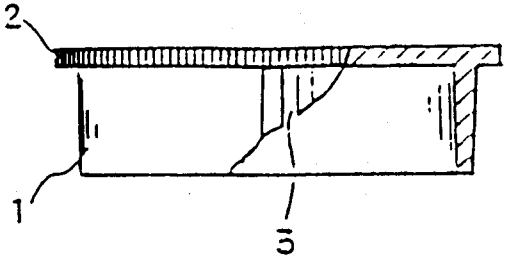
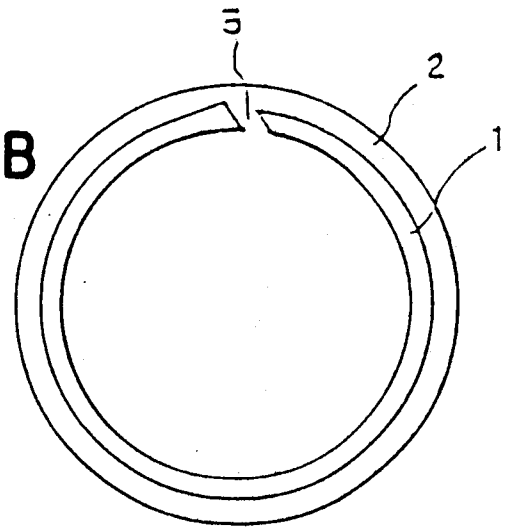
FIG.2B

BALLOON HOLDER

BACKGROUND OF THE INVENTION

This invention relates generically to a balloon holder. More particularly, the present invention relates to a holder for fixing the end portion of a string fitted to a balloon inflated by helium gas.

Conventionally, balloons inflated by helium gas have been sold to customers by tying a gas inlet after the gas is charged, binding a string to the tied portion and passing the end portion of this string to the customer.

Generally, the balloons are handed over in the manner described above but since people who purchase or carry them around are mostly children, they often inadvertently let the strings go while carrying them around, and they can catch the suspending strings inside a room having a low ceiling but cannot inside a room having a high ceiling or outdoors, so that the balloons fly high up and away.

This causes a social problem recently. In other words, the flying balloons are caught by high voltage cables and a great deal of labor and cost are necessary in order to remove them therefrom. Accordingly, a movement against the sale of the balloons has been made in certain states.

SUMMARY OF THE INVENTION

It is therefore an object of the present invention to provide a balloon holder which prevents a balloon from flying high up out of one's reach even when one lets a string go.

It is another object of the present invention to provide a balloon holder which can freely adjust the length of the yarn.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawings.

BRIEF DESCRIPTION OF THE DRAWINGS

FIGS. 2(A) and 2(B) show the structure of an external cap; and

FIGS. 3(A) and 3(B) show the structure of an internal cap.

DESCRIPTION OF THE PREFERRED EMBODIMENT

Figure 1:
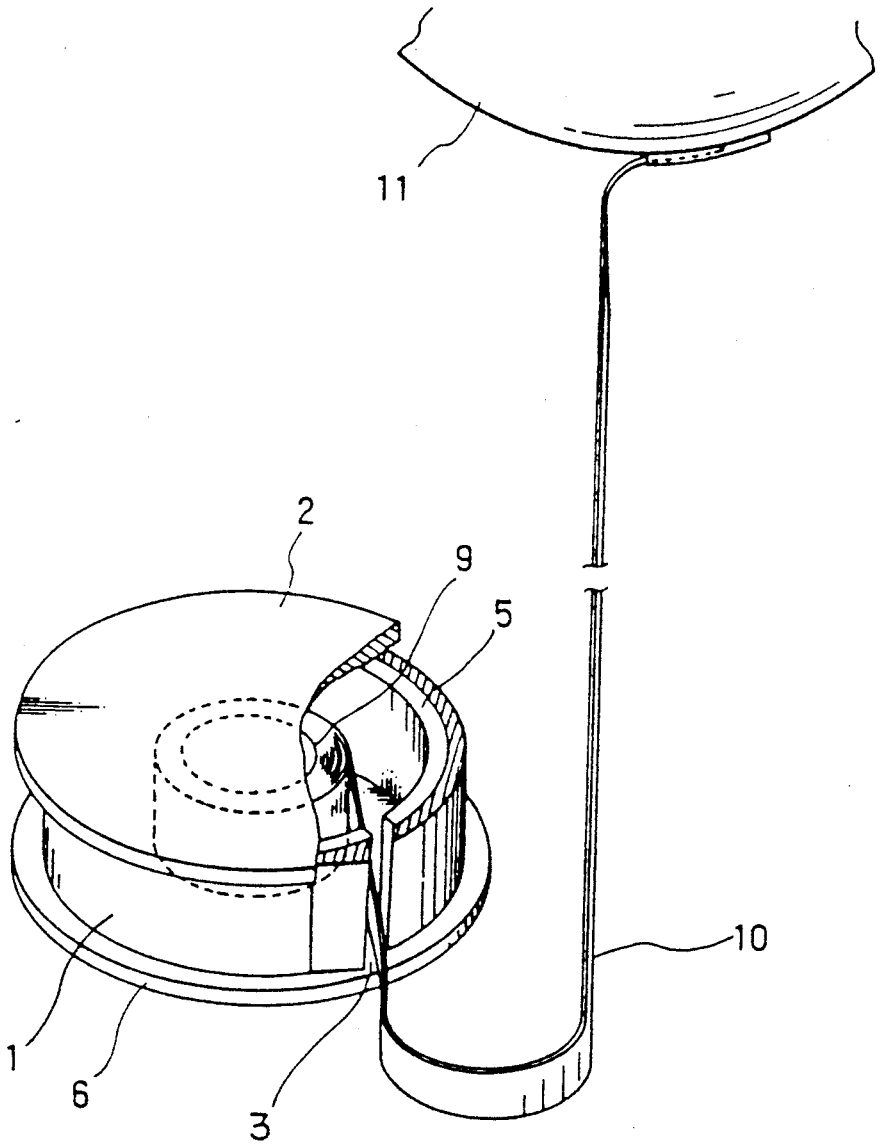
FIG. 1 is a partial cut-away perspective view showing the state of use of an embodiment of the present invention.

Hereinafter, a preferred embodiment of the present invention will be explained with reference to the accompanying drawings.

In the drawings, reference numeral 1 represents a shallow cylindrical external cap, which has knurled flanges 2 around its outer periphery. A slit 3 is formed on the side surface of the external cap 1 in a vertical direction. Generally, this slit 3 is inclined from the radial direction of the external cap 1. Reference numeral 5 represents a shallow cylindrical internal cap, which is to be fitted into the external cap 1 and has knurled flanges 6 around its outer periphery. Each of said caps includes a cylindrical sleeve and a disc shaped end flange extending beyond the sleeve. A slit 7 is formed on the side surface of the internal cap 5 in the vertical direction. A recess is formed on the bottom surface of the external cap 1 and/or the internal cap 5 or decorative paper is bonded to the bottom surface without forming such a recess. Still alternatively, the caps can be made transparent and decorative paper, or the like, can be bonded to the inside of the caps. Reference numeral 9 represents a core, which is stored in the internal cap 5, and a string 10 is wound on this core 9. The kind of the yarn is not particularly limitative and a tape-like yarn such as shown in the drawing can be used, too. The core 9 is not fixed at any position inside the internal cap 5 but can freely move and rotate. If the core 9 is fixed, the string 10 cannot be pulled out at its intermediate portion because outwardly wound string fastens inwardly wound string. If the core 9 is under the free state, on the contrary, the core 9 is pulled and rotated as the string 10 is pulled out, so that the string 10 can be pulled out reliably to the end. The string 10 is pulled out through the slits 7 and 3 and its tip is fixed to the balloon 11 by suitable method such as bonding, bonding by an adhesive tape, and the like. In the case of the tape-like string shown in the drawing, bonding by the adhesive tape is simple and easy. The external cap 1, the internal cap 5 and the core 9 are made of plastic materials, thick paper, or the like, and their total weight is in advance set to be greater than buoyancy of the balloon 11.

In the structure described above, after the core 9 is stored in the internal cap 5 the cap is then fitted into the external cap 1. After the slits 3 and 7 are registered, the string 10 is pulled out and the external cap 1 and the internal cap 5 are rotated in the mutually opposite directions so as to deviate the slits 3 and 7 from each other. In this manner, the string is clamped between the inner side surface of the external cap 1 and the outer side surface of the internal cap 5 and cannot be pulled out any more. At the sale of the balloon, the slits 3 and 7 are registered and the string 10 is pulled out in a suitable length. The balloon 11 is fixed to the tip of this string 10 and is then handed over. Even if one removes his hand from the string under this state, the balloon 11 does not freely fly away because the weight of the holder is greater than the buoyancy of the balloon 11. The length of the string 10 can be adjusted freely. To shorten the string, it is fed into the cap while the slits 3 and 7 are in agreement. Alternatively, the string 10 can be wound on the core 9 taken out by removing the internal and external caps 1 and 5.

As described above, the present invention provides the effects that the balloon does not fly up and away even one removes his hand from the string and the length of the string can be adjusted freely.

What is claimed is:

1. A holder for attachment to a balloon comprising:

a shallow cylindrical external cap;

a cylindrical internal cap fitted into said external cap; each of said caps including a cylindrical sleeve having a disc shaped end flange extending beyond said sleeve;

a core having string wound thereon and stored under a free state having a movable axis of rotation inside of said external and internal caps;

each of said external and internal caps being equipped with a slit which communicates with each other when said external and internal caps are rotated, making it possible to pull out said string;

said internal cap having an outer wall and said external cap having an inner wall with said outer wall and said inner wall rotatable in close proximity to each other and spaced to clamp said string between said walls;

said external and internal caps and said core having a total weight thereof greater than the buoyancy of the balloon to be fitted.

2. The balloon holder according to claim 1, wherein said string is tape-like.

3. The balloon holder according to claim 1, wherein said external cap and/or said internal cap have knurled flanges.

4. The balloon holder according to claim 1, wherein said slit of said external cap is inclined from the radial direction of said external cap.

* * * * *